US009366490B2

(12) United States Patent
Lescure

(10) Patent No.: US 9,366,490 B2
(45) Date of Patent: Jun. 14, 2016

(54) FLEXIBLE CHUTE, IN PARTICULAR FOR AMMUNITION

(71) Applicant: ETAT FRANCAIS REPRESENTE PAR LE DELEGUE GENERAL POUR L'ARMEMENT, Bagneux (FR)

(72) Inventor: Jean-Francois Lescure, Bourges (FR)

(73) Assignee: ETAT FRANCAIS REPRESENTE PAR LE DELEGUE GENERAL POUR L'ARMEMENT, Paris (FR)

( * ) Notice: Subject to any disclaimer, the term of this patent is extended or adjusted under 35 U.S.C. 154(b) by 0 days.

(21) Appl. No.: 14/429,242

(22) PCT Filed: Sep. 19, 2013

(86) PCT No.: PCT/FR2013/000248

§ 371 (c)(1),
(2) Date: Mar. 18, 2015

(87) PCT Pub. No.: WO2014/044931

PCT Pub. Date: Mar. 27, 2014

(65) Prior Publication Data

US 2015/0233658 A1 Aug. 20, 2015

(30) Foreign Application Priority Data

Sep. 19, 2012 (FR) ..... 12 02485

(51) Int. Cl.
*F41A 9/57* (2006.01)

(52) U.S. Cl.
CPC ..... *F41A 9/57* (2013.01)

(58) Field of Classification Search
CPC ..... F41A 9/57; F41A 9/54; F41A 9/55; F41A 9/56
USPC ..... 89/33.2, 33.14, 33.5; 193/25 AC
See application file for complete search history.

(56) References Cited

U.S. PATENT DOCUMENTS

| | | | | |
|---|---|---|---|---|
| 2,351,370 A | | 6/1944 | Schaaff | |
| 2,378,652 A | * | 6/1945 | Mills | B65G 11/103 193/25 AC |
| 2,419,315 A | * | 4/1947 | Elliott | B65G 11/106 193/25 AC |
| 2,473,716 A | * | 6/1949 | Lewis | F41A 9/57 193/25 AC |
| 2,477,264 A | * | 7/1949 | Pearson | B65G 11/103 193/25 AC |

(Continued)

FOREIGN PATENT DOCUMENTS

| | | |
|---|---|---|
| CA | 2539900 A1 | 4/2005 |
| FR | 2 753 784 A1 | 3/1998 |

(Continued)

OTHER PUBLICATIONS

International Search Report, dated Nov. 15, 2013, from corresponding PCT application.

*Primary Examiner* — Joshua Freeman
(74) *Attorney, Agent, or Firm* — Young & Thompson

(57) ABSTRACT

In the field of feeding ammunition to a firearm there is disclosed a flexible chute including successive sections (2) linked by portions of walls (111, 112, 131) at the transverse faces thereof and including at least one tubular section (2) of axis G with a first portion of wall (111, 112) integral with one of the two transverse faces thereof and a second portion (131) of wall integral with the other transverse face, characterized in that the projections of these portions of wall, perpendicular to a transverse plane of the section, are at least partially separate.

20 Claims, 5 Drawing Sheets

(56) References Cited

U.S. PATENT DOCUMENTS

| | | | | | |
|---|---|---|---|---|---|
| 2,488,679 | A * | 11/1949 | Nobles | F41A 9/57 | 193/25 AC |
| 2,596,252 | A * | 5/1952 | Kolehmainen | F41A 9/57 | 123/25 R |
| 2,838,154 | A * | 6/1958 | Van Fossen | B65G 11/103 | 193/25 AC |
| 2,890,779 | A * | 6/1959 | Aumann | B65G 11/103 | 193/25 AC |
| 2,953,230 | A * | 9/1960 | Aumann | B65G 11/103 | 193/25 AC |
| 3,250,360 | A * | 5/1966 | Correll | F41A 9/57 | 193/25 AC |
| 3,307,452 | A * | 3/1967 | Meunier | F41A 9/57 | 193/25 AC |
| 3,435,937 | A * | 4/1969 | Tassie | F41A 9/57 | 193/25 AC |
| 5,932,831 | A | 8/1999 | Bandera | | |
| 8,752,466 | B1 * | 6/2014 | Howell | F41A 9/57 | 193/25 AC |

FOREIGN PATENT DOCUMENTS

| | | | |
|---|---|---|---|
| WO | 2005/031243 | A1 | 4/2005 |
| WO | 2013/114010 | A1 | 8/2013 |

* cited by examiner

FLEXIBLE CHUTE, IN PARTICULAR FOR AMMUNITION

CROSS REFERENCE TO RELATED APPLICATIONS

Applicant claims priority under 35 U.S.C. 119 of French patent application No. 1202485 filed on Sep. 19, 2012.

BACKGROUND OF THE INVENTION

1. Field of the Invention

The invention relates in particular to the field of feeding ammunition to a firearm and particularly to a flexible chute to guide a flexible ammunition belt from an ammunition box to a firearm.

This chute is intended to be attached on the one hand near a cartridge box and on the other hand at the inlet of the feeding chute of the weapon; by design, it has the necessary and sufficient flexibility in bending and in torsion to allow the movements of the weapon without imparting more deformations to the belt than those required for its proper operation.

2. Description of Related Art

In many cases, the gun numbers of small-caliber machine-guns, up to 12.7 mm, feed their weapon with an ammunition box, or even without ammunition box, they then have at their disposal only 100 or 200 shots available that they must watch over during the shot so as to avoid any inopportune hooking before inserting the ammunition, which could block the weapon or damage its proper operation.

Today, in particular for new weapons or new weapon systems, there are flexible and metal ammunition chutes. These chutes are constituted by a series of component assemblies mounted one behind the other, so as to form successive joints and constitute a chute with a length sufficient to link an ammunition box and a weapon to thereby ensure the ammunition feeding of the weapon. These devices have many disadvantages such as their complexity of production, the need for a significant maintenance to maintain the joints in a proper state.

To overcome these disadvantages, U.S. Pat. No. 3,435,937 discloses a chute with a partially rectangular cross-section comprising a large longitudinal groove on one of its long sides and formed by a succession of identical sections, two successive sections being linked by lateral wall portions on each of the lateral faces of the short sides thereof. Thus, two half-blind grooves arranged in a same plane divide two successive sections and the chute comprises n assemblies of two half-blind grooves arranged in parallel planes and allow some flexibility of the chute, the longitudinal groove also participating in the flexibility of the chute, as indicated in the description relating to FIG. 2 of said patent.

"Lateral wall portion" is intended to mean that these lateral wall portions do not link the small lateral sides on their entire length, but only on a portion of the latter.

However, such a chute shows a flexibility only in a plane, which significantly restricts its use.

SUMMARY OF THE INVENTION

An object of the invention is to provide a flexible chute allowing to overcome all disadvantages of the state of the art, and particularly to provide a light ammunition chute which is flexible in at least two planes, does not need any maintenance, has a very low cost, is easy to implement and to repair on the field.

The solution is a flexible chute for ammunition, comprising successive sections linked by wall portions on the transverse faces thereof and comprising at least one tubular section of axis G, with a first wall portion integral with one of its two transverse faces and a second wall portion integral with the other transverse face, characterized in that the projections of these wall portions, perpendicularly to a transverse plane of the section, are at least partly distinct.

"Distinct" is intended to mean that the projections, in a same transverse plane, for example one of the transverse faces, are entirely distinct; they thus have no common point.

According to another feature, said projections are radially offset by an angle between $\pi/9$ and $8\pi/9$, and preferably between $\pi/3$ and $2\pi/3$, the origin of the radius being the center G.

According to a particular feature, a flexible chute for ammunition according to the invention comprises successive sections linked by wall portions on the transverse faces thereof, characterized in that it comprises at least one tubular section comprising at least an upper long side, a lower long side and two smaller lateral sides, and in that this section comprises, on a first transverse face, at least one wall portion only on at least one of said lateral sides and, on its second transverse face, at least one or more wall portions only on one of the upper and lower long sides or both.

According to an additional feature, the solution is a flexible chute for ammunition comprising successive sections linked by wall portions on the transverse faces thereof, characterized in that it comprises at least first, second and third successive tubular sections comprising at least an upper long side, a lower long side and two smaller lateral sides, and such that the first section is linked to the second section only by one or several axial wall portions on each of the transverse faces of their lower and/or upper long sides facing each other, while the second section is linked to the third section only by one or more lateral wall portions on each of the transverse faces of their smaller lateral sides facing each other.

Thus, the first and second sections are partially separated by a first and a second groove arranged in a first plane and facing each other, while the second and third sections are partially separated by a third and a fourth groove arranged in a second plane and facing each other, the first and second grooves being radially offset with respect to the third and fourth grooves. This radial offset allows to obtain a flexibility of the first section with respect to the second section along a first direction, and a flexibility of the second section with respect to the third section along a second direction different from the first direction.

In this patent application, the term "axial" does not have a geometrical meaning, but is used to distinguish the wall portions linked to the long sides from the wall portions, called lateral wall portions, linked to the smaller lateral sides.

According to a particular feature, a chute according to the invention is characterized in that it comprises at least first and second successive assemblies, each having first and second tubular successive sections comprising at least an upper long side and a lower long side and two smaller lateral sides, and such that the first section is united to the second section only by one or more axial wall portions on each of the transverse faces of their lower and upper long sides, and in that the first assembly is united to the second assembly only by one or more lateral wall portions on each of the transverse faces of their smaller lateral sides.

According to a particular feature, said section(s) is/are tubular with a rectangular transverse outer shape, with two long sides having the same length and being linked to two other smaller sides, also having the same length.

According to another particular feature favoring the flexibility of the chute, each of the sections has a thickness, measured lengthwise, lower than 2 cm and preferably between 0.3 and 1 cm.

According to another feature, the lateral wall portions are concentrated in the middle part of the transverse faces of said small sides.

According to another additional feature, the axial wall portions are concentrated in the middle part of the transverse faces of said long sides.

According to another feature facilitating its production, the chute is monobloc, preferably made of plastic or elastomer, thus allowing the production thereof by molding.

According to another feature allowing to unite the chute to a weapon or an ammunition box, a flexible chute according to the invention comprises, at least at one of its ends, an adaptation tip comprising a first part having mainly an inner diameter slightly greater than the outer diameter of the flexible chute and a second part with an inner diameter equal to that of the chute.

According to another feature allowing to unite to each other two non-linked chute parts, a chute according to the invention comprises at least a device, this device comprising a U-shaped plate, the size between the branches of which is equal or slightly greater than the thickness of the chute, and the width of the plate is substantially equal to that of two sections arranged side-by-side, and which comprises lateral edges so as to form a component to be clipped on two sections arranged side-by-side.

BRIEF DESCRIPTION OF THE DRAWINGS

Other advantages and features will become more apparent from the description of a particular embodiment of the invention, in reference with the appended drawings:

FIG. 3*a* shows a top view of an assembly of said chute, whereas

DESCRIPTION OF THE PREFERRED EMBODIMENTS

Figure 1:
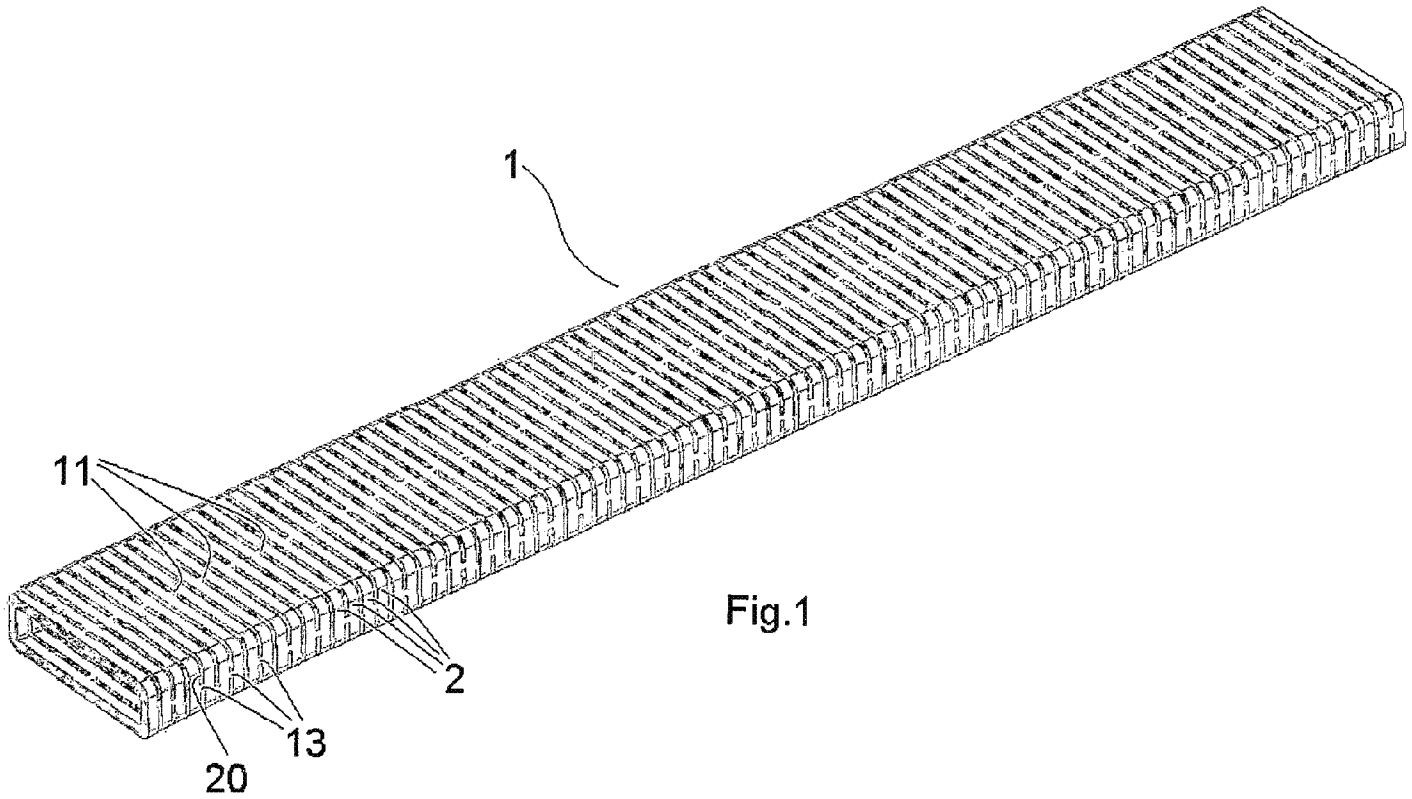
FIG. 1 shows an example embodiment of a flexible chute for ammunition made of plastic by molding.

FIG. 1 shows an example embodiment of a flexible chute for ammunition made of plastic by molding.

This chute 1 has a general tubular shape with a rectangular cross-section having outer dimensions of 25 mm×86 mm, and a wall thickness of 5 mm, thus having a cavity with a rectangular cross-section having dimensions of 15 mm×76 mm intended to allow the passage of 7.62 link-mounted ammunition to form a belt.

Figure 2A:
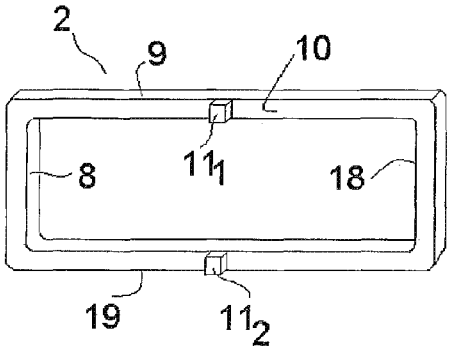
FIGS. 2*a* and 2*b* show the global shape of a section used in FIG. 1.
Figure 2B:
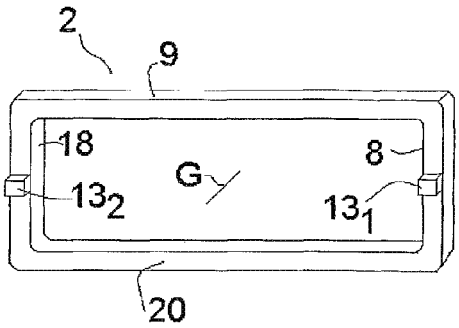

This flexible chute 1 is mainly constituted of successive sections 2 linked by wall portions 11, 13 on their transverse faces. FIGS. 2*a* and 2*b* show the general shape of a section used in this example embodiment of the invention, and more particularly, respectively, a diagram of a perspective view of one of the transverse faces of a section 2 used in the frame of the chute 1, and a diagram of a perspective view of the other transverse face. This section 2 has a rectangular tubular shape of axis G, with first and second parallel small sides 8, 18 linked to first and second parallel long sides 9, 19, and first and second parallel transverse faces 10, 20 intended to face different sections. The outer dimensions of this section are 25 mm×86 mm, and the section of the walls is of about 5 mm×5 mm.

Figure 2C:
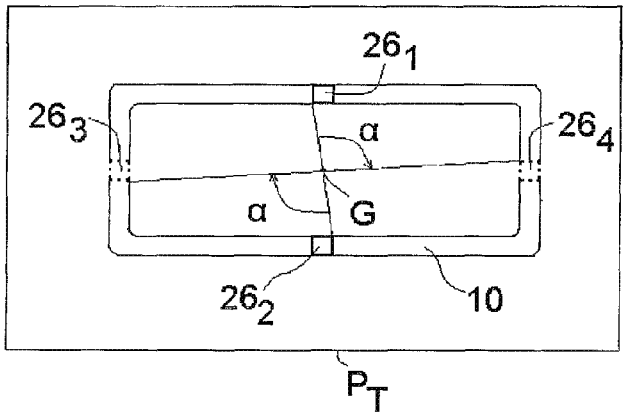
FIG. 2*c* shows a diagram of the projection of the axial and lateral wall portions of a section in a transverse plane of this section.

FIG. 2*c* shows a projection of the section 2 and of the wall portions associated therewith in the transverse plane $P_T$ containing its transverse face 10, the center of which is G, G also being on the axis of the tubular-shaped section and on the axis of the chute when it is rectilinear. It can be noted that the projections $\mathbf{26}_1$, $\mathbf{26}_2$ perpendicular to Pt of the axial wall portions $\mathbf{11}_1$ and $\mathbf{11}_2$ are entirely distinct from those $\mathbf{26}_3$, $\mathbf{26}_4$ of the lateral wall portions $\mathbf{13}_1$ and $\mathbf{13}_2$, and all projections of these wall portions are distinct. Furthermore, G being the origin, the projections $\mathbf{26}_3$, $\mathbf{26}_4$ of the lateral wall portions $\mathbf{13}_1$ and $\mathbf{13}_2$ are respectively offset with respect to those of the axial wall portions $\mathbf{11}_1$ and $\mathbf{11}_2$ by an angle $\alpha$ equal to $\pi/2$.

Figure 3A:
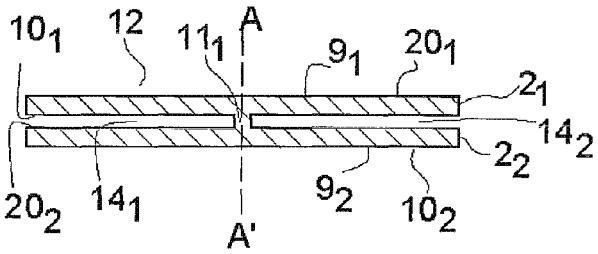
Figure 3B:
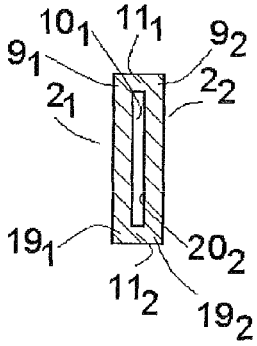
FIG. 3*b* shows a cross-sectional view thereof according to the plane AA' in FIG. 3*a*.

The chute 1 according to this embodiment is constituted of a succession of identical assemblies, such as the assembly shown in the top view of FIG. 3*a* and FIG. 3*b*, with a cross-sectional view according to the plane AA' in FIG. 3*a*.

Each assembly 12 is constituted of a first section $\mathbf{2}_1$ and a second section $\mathbf{2}_2$ arranged in parallel and side-by-side, such that the transverse surface $\mathbf{10}_1$ of the first section $\mathbf{2}_1$ faces the transverse surface $\mathbf{20}_2$ of the second section $\mathbf{2}_2$. These first and second sections $\mathbf{2}_1$, $\mathbf{2}_2$ are united, on the one hand, to a first axial wall portion $\mathbf{11}_1$ linking the first long side $\mathbf{9}_1$ of the first section $\mathbf{2}_1$ to the first long side 9 of the second section $\mathbf{2}_2$, and, on the other hand, to a second wall portion $\mathbf{11}_2$ linking the second long side $\mathbf{19}_1$ of the first section $\mathbf{2}_1$ to the second long side $\mathbf{19}_2$ of the second section $\mathbf{2}_2$. These first and second axial wall portions $\mathbf{11}_1$ and $\mathbf{11}_2$ have a transverse section of about 5 mm×5 mm and, longitudinally, a thickness of about 3 mm.

Figure 4:
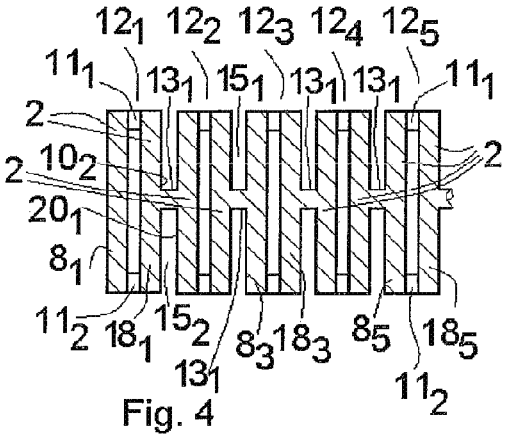
FIG. 4 shows a diagram of a side view of the first five assemblies of said chute.

FIG. 4 shows a diagram of a side view of the first five assemblies $\mathbf{12}_1$, $\mathbf{12}_2$, $\mathbf{12}_3$, $\mathbf{12}_4$, $\mathbf{12}_5$ of the chute 1. The first assembly $\mathbf{12}_1$ is united to the second assembly $\mathbf{12}_2$, on the one hand, by a first lateral wall portion $\mathbf{13}_1$ linking the first small side $\mathbf{8}_2$ of the second section $\mathbf{2}_2$ of the first assembly $\mathbf{12}_1$ to the first small side $\mathbf{8}_1$ of the first section $\mathbf{2}_1$ of the second assembly $\mathbf{12}_2$, and, on the other hand, by a second lateral wall portion $\mathbf{13}_2$ linking the second small side $\mathbf{18}_2$ of the second section $\mathbf{2}_2$ of the first assembly $\mathbf{12}_1$ to the second small side $\mathbf{18}_1$ of the first section $\mathbf{12}_1$ of the second assembly $\mathbf{12}_2$.

Thus, except for the first and last sections, each section is linked, on the one hand, to the preceding one by first and second axial wall portions $\mathbf{11}_1$ and $\mathbf{11}_2$ respectively linking their first and second long sides, and, on the other hand, to the following section by first and second lateral wall portions $13_1$ and $13_2$ respectively linking their first and second small lateral sides.

As can be seen in FIGS. 3*a* and 4, said first and second axial wall portions $11_1$ and $11_2$ link the long sides at the middle part thereof, and said first and second lateral wall portions $13_1$ and $13_2$ also link the small sides at the middle part thereof.

The first and second upper and lower wall portions $11_1$ and $11_2$ provide the chute with a flexibility in the width direction of the chute, while said first and second lateral wall portions $13_1$ and $13_2$ provide the chute with a flexibility in the thickness direction of the chute.

Thus, as shown in FIG. 3, within the same assembly, the sections $2_1$ and $2_2$ are separated by first grooves $14_1$ and $14_2$ facing each other and having a C-shape with respect to the material forming the assembly, while two successive assemblies are separated by second grooves $15_1$ and $15_2$ facing each other and having a U-shape with respect to the material forming the assembly. These first and second grooves each have a symmetry plane, and the symmetry plane of the first grooves $14_1$ and $14_2$ is perpendicular to that of the second grooves $15_1$ and $15_2$.

Figure 5A:
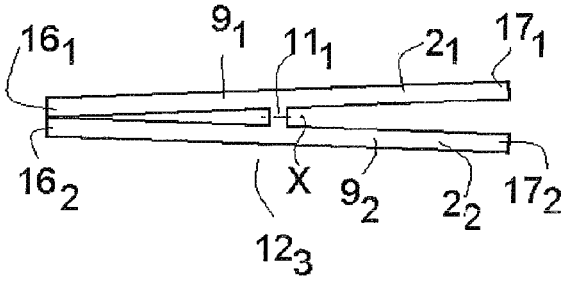
FIG. 5*a* shows a diagram of a top view of an example of deformation of the sections of an assembly.

FIG. 5*a* shows a diagram of a top view of an example of deformation of the sections $2_1$, $2_2$ of an assembly $12_3$. It can be noted that due to:

- small dimensions of the axial wall portions $11_1$ and $11_2$ linking the long wall sides generating the first grooves $14_1$ and $14_2$ with a C-shape,
- some elasticity of the material constituting the chute, the position of the first section $2_1$ can vary with respect to that of the second section $2_2$, and more particularly symmetrically with respect to the longitudinal neutral axis passing through said axial wall portions $11_1$ and $11_2$. Thus, the end $16_1$ of the long side $9_1$ of the first section $2_1$ abuts against the end $16_2$ of the second section $2_2$, while the end $17_1$ of the long side $9_1$ of the first section $2_1$ is at a longer distance from the end $17_2$ of the second section $2_2$, thus generating a bending of this assembly in the plane formed by the first long sides 9.

Figure 5B:
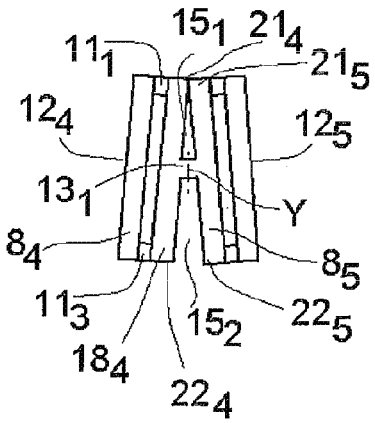
FIG. 5*b* shows a diagram of a side view of an example of deformation of two successive assemblies.

FIG. 5*b* shows a diagram of a side view of an example of deformation of two successive assemblies $12_4$, $12_5$. It can be noted that due to:

- small dimensions of the lateral wall portions $13_1$ and $13_2$ linking the long wall sides generating the second grooves $15_1$ and $15_2$ with a U-shape,
- some elasticity of the material constituting the chute, the position of the assembly $12_4$ can vary with respect to that of the assembly $12_5$, and more particularly symmetrically with respect to the transverse neutral axis passing through the center of said lateral wall portions $13_1$ and $13_2$. Thus, the end $21_4$ of the small lateral side $18_4$ of the assembly $12_4$ abuts against the end $21_5$ of the small lateral side $8_5$ of the assembly $12_5$, while the end $22_4$ of the small lateral side $18_4$ of the assembly $12_4$ is at a longer distance from the end $22_5$ of the small lateral side $8_5$ of the assembly $12_5$, thus generating a bending of these assemblies in a plane perpendicular to that formed by the first long sides 9.

When the chute is bent, particularly lengthwise, the ends 16, 21 are in contact with each other, while the other ends 17, 22 show an increased gap. When a belt is towed, it tends to adopt the shortest path, the ammunition belt will thus tend to bear on the side where the sections are in contact with each other. Accordingly, the likelihood that the most sensitive part of the ammunition belt, namely the tip side of the cartridges, is blocked in the grooves between the sections is practically zero.

With this geometry, a bending radius of 110 mm was obtained in the thickness direction of the chute and a bending radius of 300 mm was obtained in the width direction of the chute.

However, the bending radii depend on the width of the grooves between each section of the flexible chute.

Obviously, the existing weapons and ammunition boxes do not have an interface allowing to unite the chute 1 to them. Accordingly, an adaptation interface, called a tip, is described below with respect to FIGS. 6-8.

Figure 6:
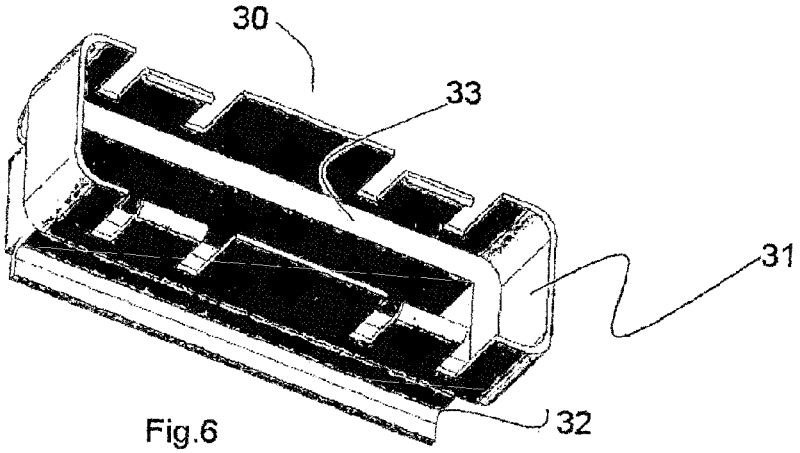
FIG. 6 shows a diagram of a perspective view of an adaptation tip 30 intended to unite the chute 1 to certain types of weapons or ammunition boxes.

FIG. 6 shows a diagram of a perspective view of an adaptation tip 30 which can be used to unite the chute 1 to certain types of weapons or ammunition boxes.

This adaptation tip 30 for flexible chute 1 has a rectangular tubular shape having:

- a first part 31 having, mainly, an inner diameter slightly greater than the outer diameter of the flexible chute,
- a second part 32 having an inner diameter equal to that of the chute,
- a shoulder 33 ensuring the interface between first and second parts 31, 32.

Figure 7:
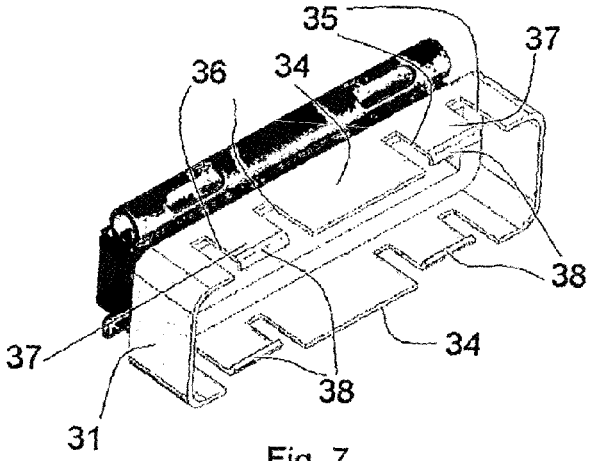
FIG. 7 shows a diagram of a first part, namely a front part, of a tip according to FIG. 6.

FIG. 7 shows a diagram of a first part, namely a front part, of a tip 30 according to FIG. 6. This first part is constituted of a steel plate with a thickness of 0.8 to 1.2 mm, with a length greater than that of an assembly 12 of the chute and with the same peripheral shape as that of a section 2, but with an inner diameter at least equal to the outer diameter of a section such that the latter can enter inside.

This steel plate comprises, on each of its long sides 34, four longitudinal notches with two notches 35 on a side of the long side and two notches 36 on the other side of the long side, so as to form two plates 37 of about 10 mm×10 mm, the free end of which is inwardly bended so as to form claws 38, and such that the distance between the shoulder and the claw is slightly greater than that of an assembly. These claws 38 are chamfered on their outer lower part. The length of the notches is sufficient to provide said plates 37 with a certain elasticity.

Thus, to unite the chute 1 to this tip, an end of the flexible chute 1 is inserted within the first part 31 of the tip such that its free transverse face is in contact with the shoulder 33. In this position, the claws 38 each are in a groove, namely the grooves 15, and the absence of chamfer on the inner part of the claws allows to block the chute in this position.

It can be noted that, because of said chamfers on the lower part of the claws 38, these slide on the corresponding lower or upper parts of the chute when the chute is inserted in the tip. To remove the chute from the tip, it is only required to pull the free ends 37 of the four plates 36, 37 towards the outside so as to simultaneously remove the claws 38 from the grooves 15 and remove the chute from the tip.

Figure 8:
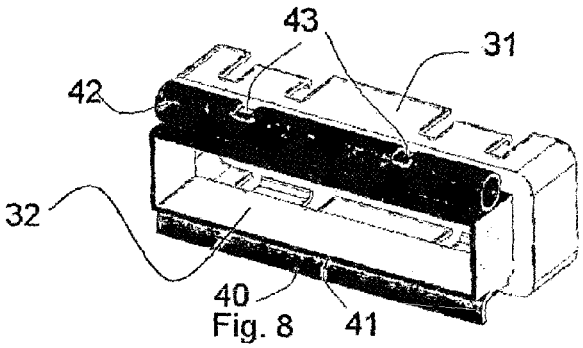
FIG. 8 shows a diagram of a second part, namely a rear part, of a tip 30 according to FIG. 6.
Figure 9:
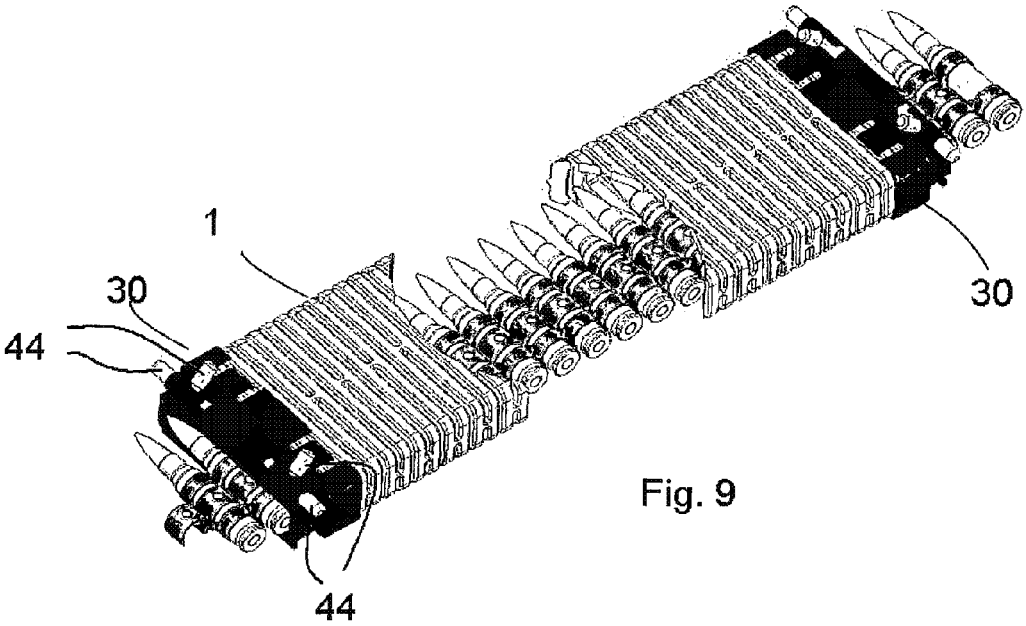
FIG. 9 shows a partially exploded view of a chute comprising an adaptation tip at each of its free ends, a cartridge belt being inserted within the chute and the tips.

FIG. 8 shows a diagram of a second part, namely a rear part, of a tip 30 according to FIG. 6. This second part 32 of the tip, shown in FIG. 8, has an inner diameter substantially equal to that of the chute 1 and further comprises means for locking this tip on a weapon or an ammunition box, constituted of a lower transverse protruding plate 40 disposed on its lower long side 41 and of a tube 42 disposed on its upper long side and having slits 43 in which flat bolt components 44 are inserted, as shown in FIG. 9. These locking means are intended to cooperate with complementary means which are not shown, and arranged on the weapon or the ammunition box.

Figure 10B:
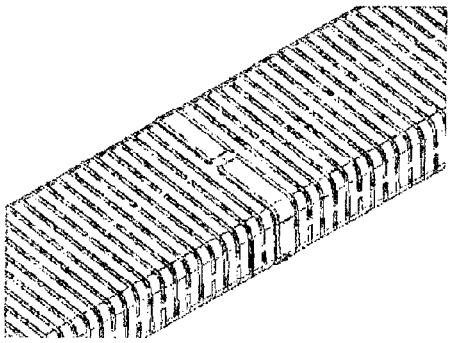
FIGS. 10*a* and 10*b* show an example of device 49 intended to repair a flexible chute according to the invention by uniting to each other two non-linked chute parts.
Figure 10A:
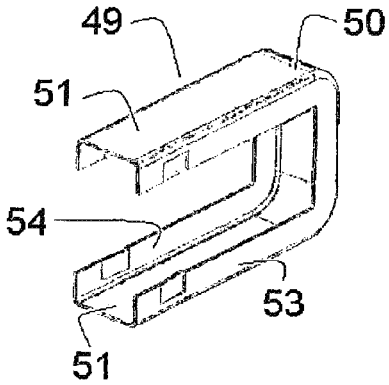

FIGS. 10*a* and 10*b* show an example of a device 49 intended to repair a flexible chute according to the invention by uniting to each other two non-linked chute parts. It is constituted of a U-shape plate 50, the size between the branches of which is equal or slightly greater than the thickness of the chute, and the length of the branches is slightly lower than half the width of the chute minus the half-width of an axial wall portion 11. The width of the plate is substantially identical to that of two sections arranged side-by-side.

This plate 50 comprises lateral edges 53, 54 so as to form a component intended to be clipped on two sections arranged side-by-side.

In case of damage to the flexible chute, accident, projectile or spall, it can be repaired within a very short period of time.

The operation mode for the repair is the following: cutting the damaged sections and the corresponding lateral wall portions 13 so as to contiguously arrange two assemblies 12. A first device 49 is arranged so as to clasp a first part of the sections facing the two contiguous assemblies, and then a second device 49 is arranged so as to clasp a second part of the sections facing the two contiguous assemblies, the first and second devices 49 facing each other.

The feeding of an ammunition belt within the chute can be performed manually or using a device such as the device described in the French patent application 1200275 filled in the name of the applicant.

Obviously, many modifications can be made to the example embodiment without departing from the scope of the invention. Thus, the dimensions of the flexible chute can be adapted to those of the ammunition used, and this invention can be adapted to all small calibers link-mounted up to 12.7 mm, or even medium calibers as well as cartridge grenades.

Moreover, a chute according to the invention can have a different shape, for example a trapezoidal or elliptical shape. If the required bending and the direction(s) thereof are known, the wall portions cannot be arranged in the middle part of the long sides and/or the middle part of the small sides so as to promote the flexibility in this/these direction(s) and this bending, and radial offsets of the wall portions along the chute can also be contemplated.

Furthermore, the sections can be gathered together by more than one wall portion on the small and/or long side. Furthermore, on all or part of the chute, said projections of the wall portions of a section can be radially offset with respect to those of the preceding or following section, the offset being regular or not along the chute.

Finally, a flexible chute according to the invention can have applications other than the feeding of a weapon with ammunition. Indeed, such a chute can be used with an endless and flexible drive chain and one or more recipients, for example a cup, for the regular feeding of a machine with objects. The chain can be, for example, a flexible belt as described in the patent application PCT/FR2013/00027, on which cups are attached, preferably in a regular manner. Such a device can be used, for example, to feed a robot with rivets, one of the ends thereof being linked to a rivet feeder and the other to a 3D robotic arm for assembling mechanical parts.

The invention claimed is:

1. A monoblock flexible chute comprising a succession of tubular sections linked together in a length direction, wherein, an outlet side of a first tubular section is linked to an inlet side of a second tubular section, an inlet side of a third tubular section is linked to an outlet side of the second tubular section, each tubular section is comprised of i) first and second walls extending in a width direction, and ii) third and fourth walls extending in a height direction between the first and second walls, the first and second walls being longer than the third and fourth walls, each tubular section has a rectangular cross section, the inlet side of each tubular section includes at least one inlet wall portion formed on at least one of the first and second walls, the at least one inlet wall portion linking the at least one of the first and second walls to the outlet side of an adjacent, upstream one of the tubular sections, and the outlet side of each tubular section includes at least one outlet wall portion formed on at least one of the third and fourth walls, the at least one outlet wall portion linking the at least one of the third and fourth walls to an adjacent, downstream one of the tubular section.

2. The flexible chute according to claim 1, wherein, the at least one inlet wall portion is formed on only one of the first wall and the second wall, and the at least one outlet wall portion is formed on only one of the third wall and the fourth wall.

3. The flexible chute according to claim 1, wherein, the at least one inlet wall portion is formed on at least one of the first wall and the second wall, and the at least one outlet wall portion is formed on each of the third wall and the fourth wall.

4. The flexible chute according to claim 1, wherein, the at least one inlet wall portion is formed on each of the first wall and the second wall, and the at least one outlet wall portion is formed on at least one of the third wall and of the fourth wall.

5. The flexible chute according to claim 4, wherein the outlet wall portions are concentrated in a middle part of transverse faces of said third and fourth walls and the inlet wall portions are concentrated in the middle part of transverse faces of said first and second walls.

6. The flexible chute according to claim 4, wherein the outlet wall portions are concentrated in the middle part of the transverse faces of said third and fourth walls or the inlet wall portions are concentrated in the middle part of the transverse faces of said first and second walls.

7. The flexible chute according to claim 1, wherein, the at least one inlet wall portion is formed on each of the first wall and the second wall, and the at least one outlet wall portion is formed on each of the third wall and of the fourth wall.

8. The flexible chute according to claim 7, wherein each of the tubular sections has a thickness, measured lengthwise, lower than 2 cm.

9. The flexible chute according to claim 7, wherein the outlet wall portions are concentrated in a middle part of transverse faces of said third and fourth walls and the inlet wall portions are concentrated in the middle part of transverse faces of said first and second walls.

10. The flexible chute according to claim 7, wherein the outlet wall portions are concentrated in the middle part of the transverse faces of said third and fourth walls or the inlet wall portions are concentrated in the middle part of the transverse faces of said first and second walls.

11. The flexible chute according to claim 7, wherein the flexible chute is made of plastic or elastomer.

12. The flexible chute according to claim 7, wherein the flexible chute further comprises, at least at one end, an adaptation tip comprising i) a first part, having an inner diameter greater than an outer diameter of the flexible chute and ii) a second part with an inner diameter equal to an inner diameter of the flexible chute.

13. The flexible chute according to claim 7, further comprising a device adapted to attach two non-linked chute parts, the device comprising i) a U-shaped plate, a size between branches of the U-shaped plate being equal or greater than a thickness of the flexible chute, and a width the U-shaped plate being equal to the width of two sections arranged side-by-side, and ii) lateral edges so as to form a component to be clipped on the two sections arranged side-by-side.

14. The flexible chute according to claim 1, wherein each of the tubular sections has a thickness, measured lengthwise, lower than 2 cm.

15. The flexible chute according to claim 1, wherein the flexible chute is made of plastic or elastomer.

16. The flexible chute according to claim 1, wherein the flexible chute further comprises, at least at one end of the flexible chute, an adaptation tip comprising a first part, having an inner diameter greater than an outer diameter of the flexible chute and a second part with an inner diameter equal to an inner diameter of the flexible chute.

17. The flexible chute according to claim 1, wherein, the flexible chute further comprises at least one device adapted to attach two non-linked chute parts, the at least one device comprising i) a U-shaped plate, wherein the size between branches of the U-shaped plate is equal or greater than a thickness of the flexible chute, and the width the U-shaped plate is equal to the width of two sections arranged side-by-side, and ii) lateral edges so as to form a component to be clipped on the two sections arranged side-by-side.

18. Application of the flexible chute according to claim 1 to a supply of ammunition of a weapon.

19. The flexible chute according to claim 1, wherein each of the tubular sections has a thickness, measured lengthwise, between 0.3 cm and 1 cm.

20. The flexible chute according to claim 1, arranged to supply ammunition of a weapon.

* * * * *